United States Patent [19]

Newman et al.

[11] Patent Number: 5,071,515

[45] Date of Patent: Dec. 10, 1991

[54] METHOD FOR IMPROVING THE DENSITY AND CRUSH RESISTANCE OF COKE

[75] Inventors: Bruce A. Newman; Lynn J. Whitebay, both of Ponca City, Okla.

[73] Assignee: Conoco Inc., Ponca City, Okla.

[21] Appl. No.: 414,218

[22] Filed: Sep. 28, 1989

Related U.S. Application Data

[63] Continuation-in-part of Ser. No. 23,738, Mar. 9, 1987, abandoned.

[51] Int. Cl.[5] ..... C10B 57/12

[52] U.S. Cl. ..... 201/17; 201/23; 201/44; 423/461; 208/131

[58] Field of Search ..... 201/9, 17, 21, 23, 25, 201/44; 208/131; 423/445, 449, 460, 461; 252/502, 510; 264/29.5, 29.7

[56] References Cited

U.S. PATENT DOCUMENTS

| | | | |
|---|---|---|---|
| 2,582,764 | 1/1952 | Bailey | 252/510 |
| 3,257,309 | 6/1966 | Fauchier et al. . | |
| 3,401,089 | 9/1968 | Friedrich et al. | 201/6 |
| 3,759,795 | 9/1973 | Oliver et al. | 201/25 |
| 3,957,957 | 5/1976 | Newman et al. | 423/448 |
| 3,996,108 | 12/1976 | Joseph | 201/6 |
| 4,148,692 | 4/1979 | Chu et al. | 201/36 |
| 4,202,734 | 5/1980 | Greenbaum | 201/6 |
| 4,521,278 | 6/1985 | Kelley et al. | 201/17 |
| 4,545,859 | 10/1985 | Kelley et al. | 201/17 |
| 4,547,284 | 10/1985 | Sze et al. | 208/131 |

FOREIGN PATENT DOCUMENTS

| | | | |
|---|---|---|---|
| 682448 | 9/1979 | U.S.S.R. | 201/21 |

*Primary Examiner*—Joye L. Woodard
*Attorney, Agent, or Firm*—Cleveland R. Williams

[57] ABSTRACT

The density and crush resistance of calcined coke are improved by depositing coker feedstock on green (uncalcined) coke, thereafter subjecting the coke to a heat soak and then calcining the coke.

29 Claims, 1 Drawing Sheet

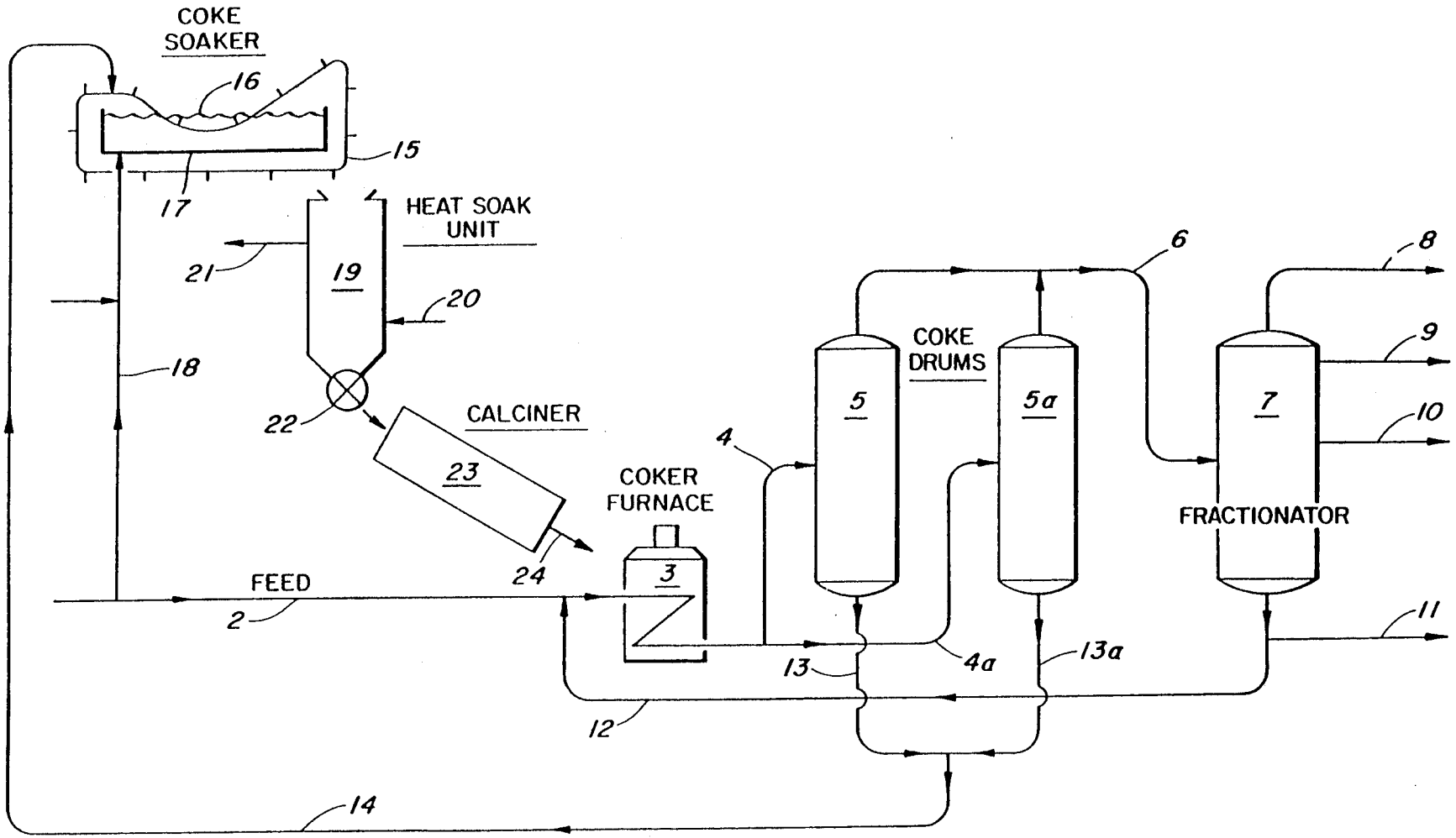
FRACTIONATOR
7
8
9
10
11
6
COKE DRUMS
5a
5
13a
4a
13
4
COKER FURNACE
3
12
CALCINER
23
24
HEAT SOAK UNIT
19
20
21
22
COKE SOAKER
15
16
17
18
FEED
2
14

METHOD FOR IMPROVING THE DENSITY AND CRUSH RESISTANCE OF COKE

PRIOR APPLICATION

This application is a continuation-in-part of application Ser. No. 07/023,738, filed Mar. 9, 1987, now abandoned.

BACKGROUND AND SUMMARY OF THE INVENTION

There is an increasing demand for high quality premium coke for the manufacture of large graphite electrodes for use in electric arc furnaces employed in the steel industry. A number of properties are of importance in characterizing the quality of graphite electrodes. One such property is density. Usually the higher the density the better the electrode. Another important property relating to premium coke is the crush resistance of the coke. The handling and processing of coke particles necessary for the manufacture of electrodes is enhanced by increasing crush resistance. This property of the coke is also a factor in the strength of the electrodes. Users of premium coke continuously seek graphite materials having higher densities. Even a small change in density can have a substantial effect on large electrode properties. Still another property which is important in characterizing the quality of premium coke is CTE, which may vary from near zero to as high as plus eight centimeters per centimeter per degree centigrade $\times 10^{-7}$. Users of premium coke also seek materials having a low CTE value.

Premium coke is manufactured by delayed coking in which heavy hydrocarbon feedstocks are converted to coke and lighter hydrocarbon products. In the process the heavy hydrocarbon feedstock is heated rapidly to cracking temperatures and is fed into a coke drum. The heated feed soaks in the drum in its contained heat which is sufficient to convert it to coke and cracked vapors. The cracked vapors are taken overhead and fractionated with the fractionator bottoms being recycled to the feed if desired. The coke accumulates in the drum until the drum is filled with coke at which time the heated feed is diverted to another coke drum while the coke is removed from the filled drum. After removal the coke is calcined at elevated temperatures to remove volatile materials and to increase the carbon to hydrogen ratio of the coke.

In the manufacture of large graphite electrodes, calcined premium coke particles obtained from the delayed coking process are mixed with pitch and then baked at elevated temperatures to carbonize the pitch.

According to this invention, calcined coke having increased density is produced by contacting the coke prior to calcining with coker feedstock and thereafter carrying out the calcining operation. In one embodiment the process is employed to obtain premium coke of increased density for use in the manufacture of electrodes employed in the production of steel.

PRIOR ART

U.S. Pat. No. 2,502,183 discloses making a dense carbon by mixing carbon aggregate, coke "flour", and pitch and hot molding the mixture to produce a dense carbon article. The patent also discloses production of carbon electrodes and other articles by hot molding a pulverized mixture containing a major proportion of carbonaceous residue together with a minor proportion of more completely carbonized material such as fully calcined petroleum coke. The only coke "flour" disclosed in the patent is calcined petroleum coke.

U.S. Pat. No. 4,105,501 discloses a process for the manufacture of metallurgical formed coke by carbonizing briquettes made by forming an outer envelope of a bituminous material over coal fines. Bituminous materials disclosed are coal tar, coal tar pitch, emulsified coal tar pitch, asphalt, modified asphalt, and heat treated asphalt.

U.S. Pat. No. 4,483,840 discloses a process in which pellets resulting from the agglomeration of anthracite or other coal fines with a binder based on pitch and/or tar are subjected to an oxidation treatment at an elevated temperature and are thereafter calcined at a still higher temperature. Resulting pellets may be used for the manufacture of all types of carbonaceous paste, electrodes and carbonaceous blocks for the linings of furnaces or electrolysis cells.

BRIEF DESCRIPTION OF THE DRAWING

The drawing is a schematic flow diagram of a premium delayed coker which illustrates one embodiment of the invention.

DETAILED DESCRIPTION OF THE INVENTION

The fresh feedstocks used in the preparation of premium coke are heavy aromatic mineral oil fractions. These feedstocks can be obtained from several sources including petroleum, shale oil, tar sands, coal and the like. Specific feedstocks include decant oil, also known as slurry oil or clarified oil, which is obtained from fractionating effluent from the catalytic cracking of gas oil and/or residual oils. Another feedstock which may be employed is ethylene or pyrolysis tar. This is a heavy aromatic mineral oil which is derived from the high temperature thermal cracking of mineral oils to produce olefins such as ethylene. Another feedstock is vacuum resid which is a heavy residual oil obtained from flashing or distilling a residual oil under a vacuum. Thermal tar may also be used as a feedstock. This is a heavy oil which may be obtained from fractionation of material produced by thermal cracking of gas oil or similar materials. Another feedstock which may be used is extracted coal tar pitch. Any of the preceding feedstocks may be used singly or in combination. In addition any of the feedstocks may be subjected to hydrotreating, heat soaking, thermal cracking, or a combination of these steps, prior to their use for the production of premium grade coke.

Feedstocks derived from a petroleum distillate have substantially lower initial boiling points than feedstocks derived from petroleum residues and tars. During a calcination reaction, feedstocks derived from petroleum distillates are flashed off and form a gaseous phase rendering them less effective for depositing carbon in the pores of green coke. In comparison, feedstocks including petroleum resids and tars derived from operations such as thermal cracking, catalytic cracking and vacuum distillation are liquid or even solid during the initial stage of a calcination reaction and form substantially more carbon when deposited on green coke.

For the purpose of distinguishing a petroleum distillate from a petroleum residual oil or tar herein; a petroleum distillate is a petroleum liquid product condensed from vapor during a distillation. The distillation is a process that consists of driving gas or vapor from liquids by heating and condensing to liquid products, that is used for purification, fractionation, or the formation of new substances.

The petroleum residual oil (resid) or tar is what is left in the bottom of the distillation column, after the overhead or lower boiling products have been distilled away. These resids or tars have substantially higher initial boiling points, contain a much higher percentage of complex aromatic compounds which results in a substantially higher percent of carbon formation during a carbonization reaction when compared with the overhead or distilled petroleum products.

It should be noted that the feedstocks suitable for use herein are those feedstocks which have an initial boiling point (IBP) of 700° F. or higher and normally have an aromatic carbon content of from about 20 wt.% to about 95 wt.%, preferably from about 50 wt.% to about 95 wt.%.

Any of the above feedstocks may be used to contact the green(uncalcined) premium coke in carrying out the process of the invention. Preferred are feedstocks which provide high yields of coke, such as thermal tars, decant oils, pyrolysis tars and various types of pitches. The green coke may be contacted with a portion of the same feedstock used in the preparation of the coke, or, if desired a different feed material may be used for this purpose.

All types of green premium coke are applicable to the process of the invention. Thus green coke prepared from any of the conventional coke feedstocks may be used. The largest improvements in coke density occur in instances where the VBD (vibrated bulk density) of the calcined coke is less than about 0.77 g/cc (for 3×6 particles). However, the process is applicable to cokes having lesser or greater density.

Referring now to the drawing, feedstock is introduced into the coking process via line 2. The feedstock which in this instance is a thermal tar is heated in furnace 3 to temperatures normally in the range of about 850° F. to about 1100° F. and preferably between about 900° F. to about 975° F. A furnace that heats the thermal tar rapidly to such temperatures such as a pipestill is normally used. The thermal tar exits the furnace at substantially the above indicated temperatures and is introduced through line 4 into the bottom of coke drum 5 which is maintained at a pressure of between about 15 and about 200 psig. The coke drum operates at a temperature in the range of about 800° F. to about 1000° F., more usually between about 820° F. and about 950° F. Inside the drum the heavy hydrocarbons in the thermal tar crack to form cracked vapors and premium coke. Cracked vapors are continuously removed overhead from coke drum 5 through line 6. The coke accumulates in the drum until it reaches a predetermined level at which time the feed to the drum is shut off and switched to a second coke drum 5*a* wherein the same operation is carried out. This switching permits drum 5 to be taken out of service, opened and the accumulated coke removed therefrom using conventional techniques. The coking cycle may require between about 16 and about 60 hours but more usually is completed in about 24 to about 48 hours.

The vapors that are taken overhead from the coke drums are carried by line 6 to a fractionator 7. In the fractionator the vapors are separated into a $C_1$–$C_3$ product stream 8, a gasoline boiling range product stream 9, a light gas oil product stream 10 and a premium coker heavy gas oil taken from the fractionator via line 11. As indicated previously, the resid from fractionator 7 may be recycled at the desired ratio to the coker furnace through line 12. Any excess net bottoms may be subjected to conventional residual refining techniques if desired.

Green coke is removed from coke drums 5 and 5*a* through outlets 13 and 13*a*, respectively, and is introduced via 14 to coke soaker 16. The coke soaker comprises a tank or container 17 of liquid thermal tar feedstock or alternatively a finely divided feedstock powder and a continuous flexible belt 15 a portion of which is immersed in the tank of feedstock. The green coke is introduced on the flexible belt 15 and passes downwardly through the bath of feedstock. The coke soaked with feedstock then passes upwardly on the belt and out of the soaker and is introduced to calciner 19. Any excess of feedstock on the coke leaving the soaker flows down the belt and back into tank 17. As feedstock is consumed in the coke soaker, additional material is introduced through line 18 in a sufficient quantity to maintain the level of feedstock in tank 17. The amount of feedstock deposited on the coke will vary depending on the particular coke and the feedstock used. Usually feedstock consumption is between about 2 and about 20 percent by weight based on the green coke.

In addition to the method disclosed other conventional procedures may be used for contacting the coke with feedstock. For example, liquid feedstock may be sprayed on the coke or, if the feedstock is a solid at ambient temperature, coke may be passed through finely divided feedstock powder.

Coke is usually removed from the coke drums with a high velocity jet of water. As a result the coke is cooled rapidly and by the time it enters the coke soaker 16 it has reached a relatively low temperature. This is important since contacting hot coke in a bath of liquid feedstock could result in boiling and vaporization of the liquid which would defeat the purpose of the invention. It is not necessary however that the coke be reduced to room temperature. A somewhat heated coke can be advantageous in the wetting process.

The flexible belt 15 may become fouled with liquid feedstock and coke particles over a period of time. It may be cleaned by washing or spraying with a lighter hydrocarbon fraction, or heated feedstock may be used for this purpose.

In heat soak unit 19 the coke soaked with coker feedstock is heated at a temperature between about 825° F. and about 1000° F. at a pressure of from about atmospheric pressure to about 200 psig, for a period of from about 1 to about 50 hours. The particular time and temperature employed in the heat soak will depend on the characteristics of the coke and the feedstock used in the coke soaker. More usually the heat soak will be carried out for about 8 to about 32 hours at a temperature between about 850° F. and about 925° F. The appropriate residence time in the heat soak unit may be established by providing a rotary valve 22 or other type control device in the bottom of the unit.

The heat soak fluid, which is introduced to the heat soak unit 19 via line 20, may be any material which is non-coking, which is a gas under the heat soak conditions of temperature and pressure, and which does not affect the properties of the premium coke. For example, the heat soak fluid may be a liquid hydrocarbon fraction or a normally gaseous material such as light hydrocarbons, nitrogen, steam or the like. In this instance a light gas oil is used as the heat soak material. If desired it may be recovered through line 21 and reused in the process. The heat required for heat soaking may be obtained by passing the heat soak fluid through any conventional furnace or heat exchanger (not shown) prior to introducing it to the heat soak unit.

In calciner 23 the green coke soaked with feedstock or having feedstock deposited thereon is subjected to elevated temperatures to remove volatile materials and to increase the carbon to hydrogen ratio of the coke. Calcination is carried out at temperatures in the range of between about 2000° F. and about 3000° F. and preferably between about 2400° and about 2600° F. The coke is maintained under calcining conditions for between about one half hour and about ten hours and preferably between about one and about three hours. The calcining temperature and the time of calcining will vary depending on the properties of the coke desired. Calcined premium coke of increased density which is suitable for the manufacture of large graphite electrodes is withdrawn from the calciner through outlet 24.

The following examples illustrate the results obtained in carrying out the invention.

EXAMPLE

Decant oil was coked in a delayed coker at 55 psig at 880° F. The coking cycle was 44 hours. 200 grams of the resulting green coke was immersed for three hours in 250 grams of thermal tar (properties are shown in Table 1) that was topped to 870 ° F. The liquid then was decanted from the coke and representative samples were heat-treated under the following conditions:

Run 1–8 hour soak time, 875° F., and 0 psig pressure;
Run 2–8 hour soak time, 925° F., 0 psig pressure;
Run 3–8 hour soak time, 875° F., 120 psig pressure;
Run 4–8 hour soak time, 925° F., 120 psig pressure.

After each heat-soak step, the coke was calcined by placing it in an oven, increasing the temperature to 2600 ° F. over a period of about 2.5 hours and thereafter maintaining the temperature at 2600° F. for 2.0 hours. To provide a base case untreated green coke was also calcined following the same procedure. VBD, crush resistance and CTE of the cokes produced in Runs 1–4 and the base case are presented in Table 2.

TABLE 1

| Feedstock | Feedstock Properties 870° F. + Thermal Tar |
|---|---|
| Specific Gravity, 60/60° F. | 1.101 |
| API Gravity | −2.98 |
| Sulfur, Wt % | 0.42 |
| Total Nitrogen, Wt % | 0.16 |
| Conradson Carbon Residue, Wt % | 9.32 |
| Pentane Insolubles, Wt % | 5.91 |
| Elements by Perkin-Elmer, Wt % | |
| C | 92.1 |
| H | 7.2 |

TABLE 1-continued

| Feedstock | Feedstock Properties 870° F. + Thermal Tar |
|---|---|
| N | 0.2 |
| O | 0.5 |
| Topping Yld. (870° F.), Wt % | 28.1 |

TABLE 2

| Experiment | Heat-Soak Temp., °F. | Heat-Soak Press., PSIG | 8 × 14 Mesh Calcined Coke VBD, g/cc | Calcined Coke Crush Resis., Wt % | Graphitized Coke CTE, $10^{-7}$/°C. No. of Samples | Graphitized Coke CTE, $10^{-7}$/°C. Avg. Value |
|---|---|---|---|---|---|---|
| Base Case | — | — | 0.836 | 49.2 | 8 | 2.22 |
| Run 1 | 875 | 0 | 0.887 | 58.2 | 4 | 2.25 |
| Run 2 | 925 | 0 | 0.878 | 52.7 | 4 | 2.28 |
| Run 3 | 875 | 120 | 0.857 | 53.6 | 4 | 1.99 |
| Run 4 | 925 | 120 | 0.888 | 58.4 | 4 | 2.03 |

It is apparent from the data that soaking the green coke with coker feedstock followed by a heat soak markedly increases the density and crush resistance of the calcined coke without adversely affecting the coke CTE.

The process of the invention has been described in its application to premium coke, however, it also can be used with other grades of coke. For example, large quantities of coke are produced for use in electrodes consumed in the manufacture of aluminum. This "aluminum coke" coke is distinguished from premium coke in its lack of the needle-like structure which denominates premium coke. While CTE is not a factor in the characterization of regular or aluminum grade coke, higher coke density is desirable for such coke when it is used in the manufacture of electrodes for manufacture of aluminum.

Aluminum grade coke is also prepared by delayed coking and calcining under much the same conditions as are used in premium coking. Highly aromatic feedstocks are not required. Usually such coke is prepared from resids or other heavy hydrocarbon fractions. Again, when aluminum grade coke is used in carrying out the invention the feedstock employed to contact the green coke may be the same feedstock used in making the coke or it may be a different feedstock.

Obviously, many modifications and variations of the invention, as herein above set forth, can be made without departing from the spirit and scope thereof, and therefore only such limitations should be imposed as are indicated in the appended claims.

We claim:

1. A process for increasing the density of calcined coke which comprises contacting green (uncalcined) coke with a finely divided feedstock powder, heat soaking the contacted coke, and thereafter calcining said coke.

2. The process of claim 1 wherein the coke is aluminum grade coke.

3. The process of claim 1 wherein the finely divided feedstock powder is a different feedstock from that used to prepare the green coke.

4. A process for increasing the density of calcined premium coke which comprises contacting green (uncalcined) premium coke with a finely divided feedstock powder, heat soaking the contacted coke, and thereafter calcining said coke.

5. The process of claim 4 wherein the finely divided feedstock powder is a portion of the same feedstock used in the preparation of the green premium coke.

6. The process of claim 4 wherein the finely divided feedstock powder is a different feedstock from that used to prepare the green premium coke.

7. A premium coking process which comprises heating an aromatic mineral oil feedstock to an elevated temperature, introducing the heated feedstock over a period of time into a coking drum under delayed coking conditions wherein the heated feedstock soaks in its contained heat to convert the feedstock to cracked vapors and premium coke, removing coke from the coke drum upon completion of the delayed coking, cooling the coke, contacting the cooled coke with a portion of the aromatic mineral oil in finely divided powder form, heat soaking the contacted coke, and calcining the contacted coke to obtain calcined premium coke of increased density.

8. The process of claim 7 wherein the aromatic mineral oil feedstock is a solid at the contacting temperature and the removed coke is passed through a finely divided powder of such feedstock.

9. A premium coking process which comprises heating an aromatic mineral oil feedstock to between about 850° F. and about 1100° F., introducing the heated feedstock over a period of time into a coking drum wherein the heated feedstock soaks in its contained heat at a temperature between about 800° F. and about 1000 ° F. and a pressure between about 15 psig and about 200 psig which is sufficient to convert the feedstock to cracked vapors and premium coke, removing coke from the coke drum upon completion of the coking with a high velocity jet of water, contacting the removed coke with a portion of the aromatic mineral oil feedstock in finely divided powder form, subjecting the contacted coke to a heat soak at a temperature between about 825° F. and about 1000° F. for between about 1 and 50 hours, and calcining the contacted coke at a temperature between about 2000° F. and about 3000° F. for from between about one half hour and about ten hours to obtain calcined premium coke at increased density.

10. The process of claim 9 wherein the aromatic mineral oil feedstock is a solid at the contacting temperature and the removed coke is passed through a finely divided powder of such feedstock.

11. The process of claim 9 wherein the aromatic mineral oil feedstock is selected from the group consisting of thermal tar, decant oil, pyrolysis tar, petroleum pitch and coal tar pitch.

12. A process for increasing the density of calcined coke which comprises depositing a coker feedstock derived from a petroleum resid having an initial boiling point of at least 700° F. and an aromatic carbon content of at least 20 weight percent, on green (uncalcined) coke and thereafter calcining said coke.

13. The process according to claim 12 wherein the coke is aluminum grade coke.

14. The process according to claim 12 wherein the coker feedstock is a different feedstock from that used to prepare the green coke.

15. The process according to claim 12 wherein the coker feedstock is a portion of the same feedstock used in the preparation of the green coke.

16. The process of claim 12 wherein the green coke is passed through a bath of liquid coker feedstock.

17. A process for increasing the density of calcined premium coke which comprises depositing a coker feedstock derived from a petroleum resid having an initial boiling point of at least 700° F. and an aromatic carbon content of at least 20 weight percent, on green (uncalcined) premium coke with a coker feedstock, heat soaking the deposited coke, and thereafter calcining said coke.

18. The process according to claim 17 in which the coker feedstock is a portion of the same feedstock used in the preparation of the green coke.

19. The process according to claim 17 in which the coker feedstock is a different feedstock from that used to prepare the green coke.

20. The process according to claim 17 in which the green coke is passed through a bath of liquid coker feedstock.

21. The process of claim 17 in which the green coke is sprayed with liquid coker feedstock.

22. A premium coking process which comprises heating an aromatic mineral oil feedstock to an elevated temperature, introducing the heated feedstock over a period of time into a coking drum under delayed coking conditions wherein the heated feedstock soaks in its contained heat to convert the feedstock to cracked vapors and premium coke, removing coke from the coke drum upon completion of the delayed coking, cooling the coke, depositing a portion of the aromatic mineral oil feedstock on the cooled coke, heat soaking the deposited coke, and calcining the deposited coke to obtain calcined premium coke of increased density.

23. The process according to claim 22 wherein the removed coke is passed through a liquid bath of the aromatic mineral oil feedstock.

24. The process according to claim 22 wherein the removed coke is sprayed with liquid aromatic mineral oil feedstock.

25. A premium coking process which comprises heating an aromatic mineral oil feedstock to between about 850° F. and about 1100° F., introducing the heated feedstock over a period of time into a coking drum wherein the heated feedstock soaks in its contained heat at a temperature between about 800° F. and about 1000° F. and a pressure between about 15 psig and about 200 psig which is sufficient to convert the feedstock to cracked vapors and premium coke, removing coke from the coke drum upon completion of the coking with a high velocity jet of water, depositing a portion of the aromatic mineral oil feedstock on the removed coke, subjecting the contacted coke to a heat soak at a temperature between about 825° F. and about 1000° F. for between about 1 hour and 50 hours, and calcining the coke at a temperature between about 2000° F. and 3000° F for between about one half hour and about ten hours to obtain calcined premium coke of increased density.

26. The process according to claim 25 in which the removed coke is passed through a liquid bath of the aromatic mineral oil feedstock.

27. The process according to claim 25 in which the removed coke is sprayed with liquid aromatic mineral oil feedstock.

28. The process according to claim 25 in which the aromatic mineral oil feedstock is selected from the group consisting of thermal tar, decant oil, pyrolysis tar and petroleum pitch.

29. The process according to claim 25 in which the feedstock is derived from a coal tar.

* * * * *